US005970771A

United States Patent [19]

Ginzburg

[11] Patent Number: 5,970,771

[45] Date of Patent: Oct. 26, 1999

[54] CONTINUOUS SPIRAL MOTION SYSTEM FOR ROLLING MILLS

[75] Inventor: Vladimir B. Ginzburg, Pittsburgh, Pa.

[73] Assignee: Danieli United, Pittsburgh, Pa.

[21] Appl. No.: 09/113,997

[22] Filed: Jul. 10, 1998

[51] Int. Cl.[6] ..... B21B 31/07

[52] U.S. Cl. ..... 72/247; 72/201; 72/252.5; 72/366.2

[58] Field of Search ..... 72/247, 237, 365.2, 72/366.2, 252.5, 241.2, 243.2, 200–202, 199

[56] References Cited

U.S. PATENT DOCUMENTS

| | | | |
|---|---|---|---|
| 4,627,260 | 12/1986 | Benz | 72/247 |
| 4,711,116 | 12/1987 | Bald . | |
| 4,864,836 | 9/1989 | Ochiai . | |
| 4,898,014 | 2/1990 | Ginzburg et al. . | |
| 4,934,166 | 6/1990 | Giacomoni . | |
| 4,955,221 | 9/1990 | Feldmann et al. . | |
| 4,978,583 | 12/1990 | Wakui et al. | 72/199 |
| 5,165,266 | 11/1992 | Ginzburg . | |
| 5,640,866 | 6/1997 | Satoh et al. . | |
| 5,655,398 | 8/1997 | Ginzburg . | |
| 5,666,842 | 9/1997 | Komatsubara et al. | 72/201 |
| 5,722,876 | 3/1998 | Mori et al. | 451/10 |

*Primary Examiner*—Joseph J. Hail, III
*Assistant Examiner*—Ed Tolan
*Attorney, Agent, or Firm*—Armstrong, Westerman, Hattori, McLeland & Naughton

[57] ABSTRACT

A system and method for improving properties of a metal strip during rolling between rotating upper and lower work rolls in a mill stand, for reducing work roll edge wear, for improving distribution of thermal expansion of the work roll during rolling, for reducing required rolling torque for achieving a particular strip thickness reduction, and for increasing the tonnage of rolled strip between roll changes, by continuously shifting the rotating work rolls during rolling to impart a spiral motion to the work rolls, and by online grinding, heat rehardening and cooling of the work rolls outside the mill stand.

17 Claims, 5 Drawing Sheets

CONTINUOUS SPIRAL MOTION SYSTEM FOR ROLLING MILLS

BACKGROUND

1. Field of the Invention

This invention relates to the rolling of elongated metal sheet and strip workpieces (hereinafter "strip") in a rolling mill stand having at least one set of upper and lower work rolls and wherein, during rolling, the work rolls are rotated around their respective longitudinal axes and, at the same time, are continuously shifted along those axes. Online work roll grinding, rehardening and cooling are performed outside the mill stand.

2. Description of the Prior Art

In conventional rolling mills, the work rolls are engaged in circular motion in respect to the rolled strip. During such rolling, the deformation in the roll bite (the vertical spacing between the work rolls) is basically two-dimensional. This is due to the frictional forces acting in the roll axial direction between the work rolls and the rolled product. In such conventional rolling process, the tonnage of product rolled between work roll changes is limited due to roll wear, roll marks, and deterioration of the roll surfaces due to fire cracks and banding. In order to reduce such roll problems, and/or to aid in strip profile and shape control during rolling, axial work roll shifting has been commonly used. Prior art patents exemplifying work roll shifting include: U.S. Pat. No. 4,711,116 (work roll shifting and bending); U.S. Pat. Nos. 4,864,836; 4,898,014; 4,934,166; 4,955,221; 5,640,866 (roll shifting and bending), and U.S. Pat. No. 5,655,398 (roll shifting and crossing). U.S. Pat. No. 5,165,266 shows a checkless roll support mechanism by means of which the work rolls may be balanced, bent in the upstream or downstream horizontal direction or vertically upwardly or downwardly, crossed or off-set.

The equipment for carrying out such conventional rolling also may be provided with online roll grinders inside the mill housing, between the drive side and the operator side of the rolling mill. Such roll grinders operate in a hostile, high temperature, corrosive environment and, consequently, do not provide accurate roll grinding. Conventionally ground work rolls are lubricated and cooled, but the amount and quality of lubricant/coolant fluid is not optimum for grinding, but rather for cooling only. Moreover, to grind the work rolls properly, it is necessary to know accurately the position of the grinding tool. In conventional grinding, inside the mill housing, the environment is a poor one for such accurate measurements. Still further, the work roll thermal crown fluctuates so that the dimensions of the work rolls change—further interfering with accurate grinding.

SUMMARY OF THE INVENTION

This invention provides a continuous, long-stroke work roll shifting during rolling to provide, with the work roll circular rotation, a spiral motion of the work roll in respect to a rolled strip and, thereby, more efficient three-dimensional deformation in the roll bite.

According to this invention, there are also provided, with the means to effect the described spiral motion of the work rolls, online work roll grinders, rehardening and cooling means located outside the mill housing at the operator side and drive side of the rolling mill and providing even distribution of the work roll wear and thermal expansion, and substantially increased rollable tonnage between work roll changes due to the relatively benign environment in which such equipment is disposed.

The invention may be practiced with advantage with use of a chockless work roll arrangement, e.g. as disclosed in U.S. Pat. No. 5,165,266 (incorporated herein by this reference) providing a simplified work roll shifting system and combined work roll bending and crossing or offsetting systems.

DESCRIPTION OF PREFERRED EMBODIMENTS

Figure 1:
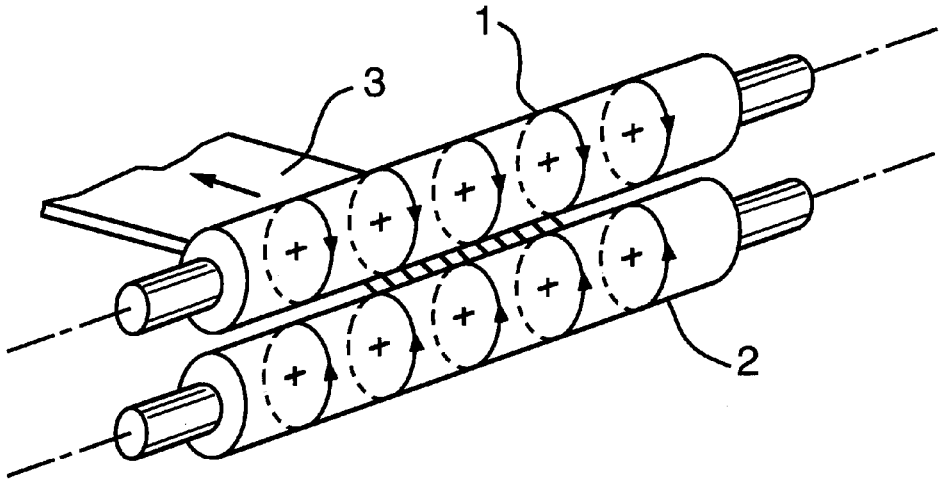
FIG. 1 Prior Art
FIG. 1 is an isometric front elevational sketch of a pair of upper and lower work rolls which, according to the prior art, rotate during rolling.
Figure 3A:
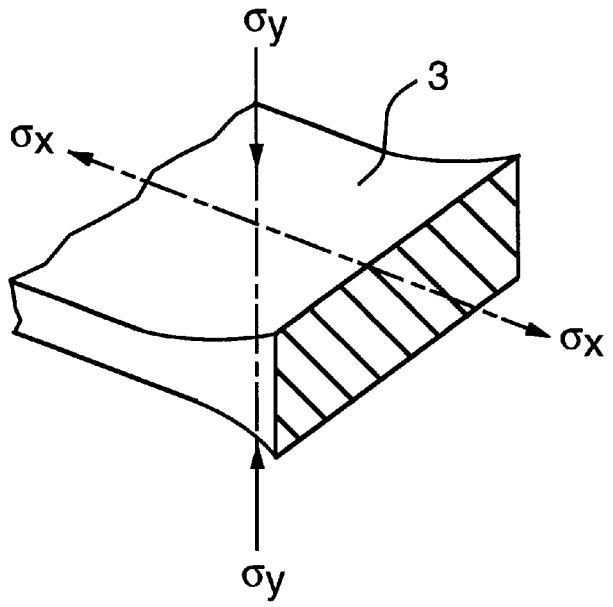
FIG. 3A Prior Art
FIG. 3A is an enlarged isometric partial cross section of strip rolled in accordance with the prior art.

As shown in FIG. 1, prior art rolling mill work rolls 1 and 2 are rotatable and roll a strip 3 between them to produce an essentially two-dimensional deformation of the strip, as shown in FIG. 3A, where $\sigma_x$=tensile stress exerted along the length of the strip, and $\sigma_y$=compressive stresses exerted on the thickness dimension of the strip.

Figure 2:
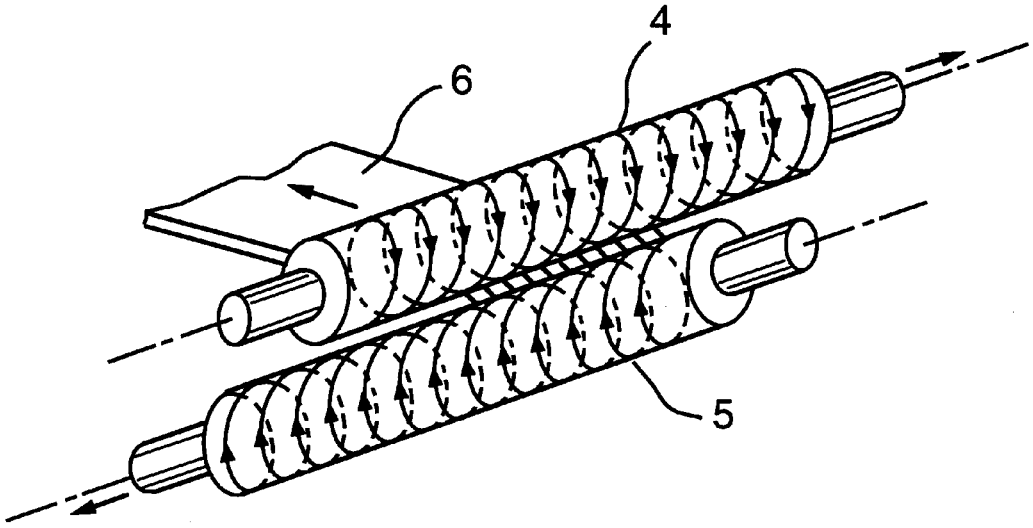
FIG. 2 is a similar sketch of a combined rotating and continuously shifting work roll system according to this invention.
Figure 3B:
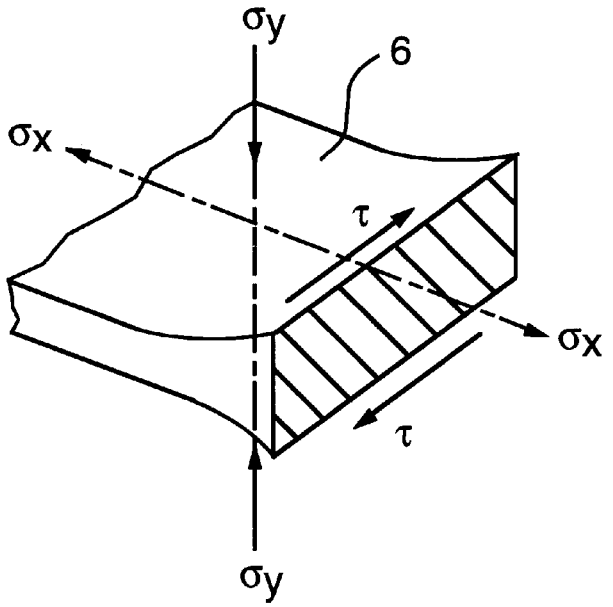
FIG. 3B is an enlarged isometric partial cross section of strip rolled in accordance with this invention.

In contrast to such prior art rolling, the present invention, as shown in FIGS. 2 and 3B, provides, in a rolling mill, preferably of the above referenced chockless roll support type, at least one pair of upper and lower work rolls 4 and 5 between which a metal strip 6 is rolled, and wherein the work rolls, in addition to rotating, also are continuously shifted in the work roll axial direction during rolling, to provide a spiral motion of the work rolls and a deformation of the strip 6 as shown in FIG. 3B, wherein $\sigma_x$=tensile stress exerted along the length of the strip, $\sigma_y$=compressive stresses exerted on the thickness dimension of the strip, and $\tau$=shear stresses exerted across the width of the strip during rolling. To the compressive and tensile forces applied by conventional rolling, such spiral rolling adds a shearing force to the rolled strip. Because of such added working of the strip during rolling, it is possible to apply less torque and less force during rolling as compared to the conventional rolling process, to achieve the same reduction in thickness of the rolled strip. Therefore, this feature of the invention provides a process advantage. It also provides a product advantage in that, in special steels, such as silicon steel, in which mechanical properties are sensitive to the amount and type of deformation, anisotropic properties, such as magnetic permeability, are induced.

Figure 4:
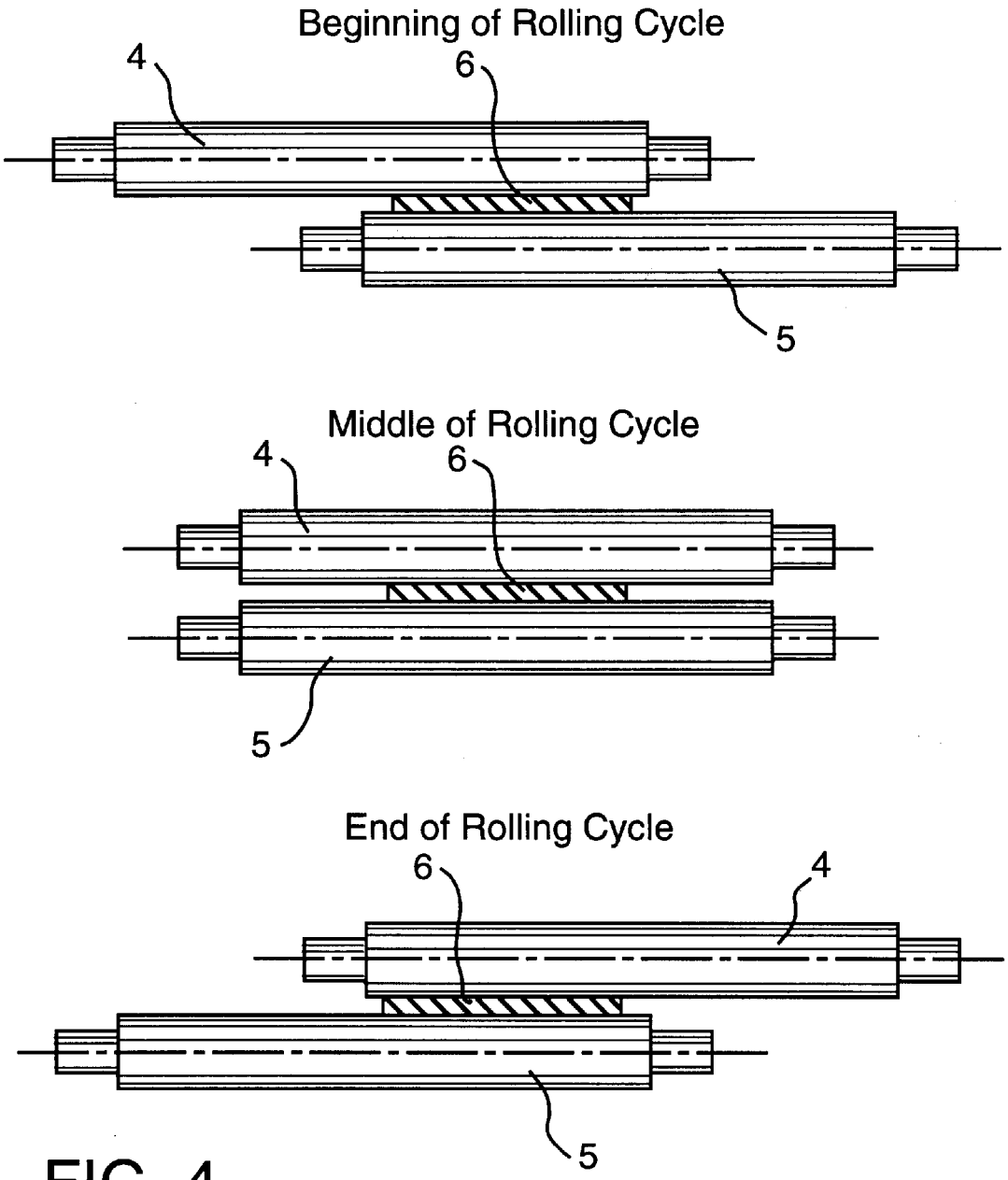
FIG. 4 is a front elevational view of a set of spaced-apart work rolls showing the manner of long-stroke shifting and spiral motion of the rotating rolls during rolling in accordance with this invention.

As will be seen by reference to FIG. 4, rolls 4 and 5 of this invention are much longer than conventional rolling mill work rolls, allowing them to be continuously axially shifted while fully juxtaposed to the strip being rolled, from the beginning, to the middle, to the end of the rolling cycle, as shown in that FIG. 4.

Figure 5:
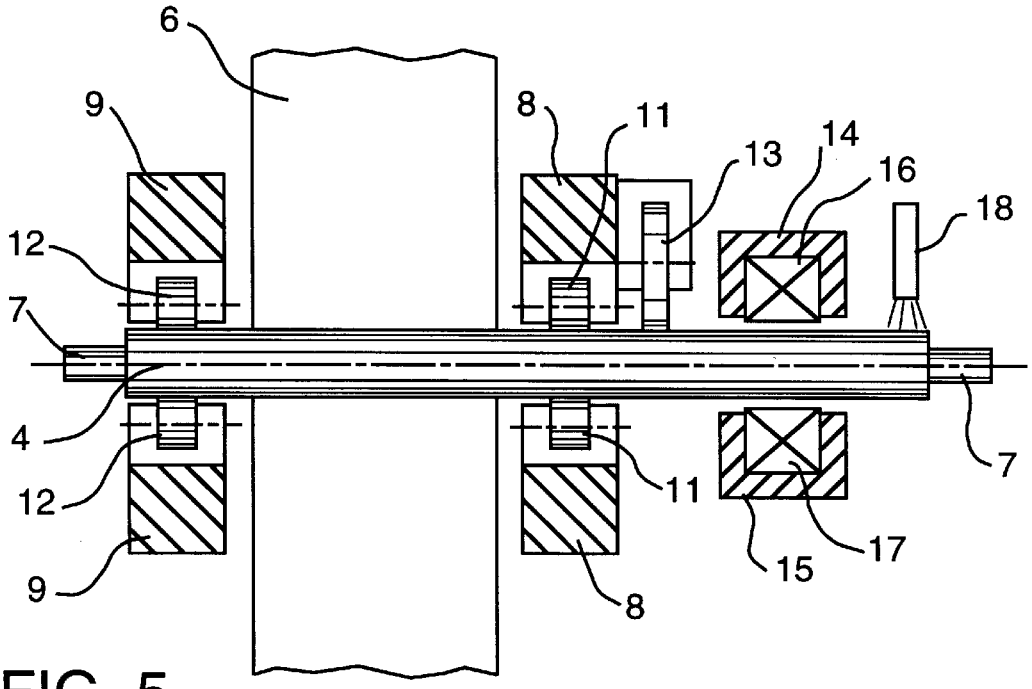
FIG. 5 is a plan view of a top work roll adapted for longstroke continuous shifting in accordance with this invention, and also showing online roll grinding, rehardening and cooling means.

Such construction of the continuous work roll spiral motion system of the invention is more fully shown in FIG. 5, wherein an upper work roll 4 is shown with roll necks 7 which are supported by suitable means in a mill housing or in Mae West blocks mounted therein (not shown). As seen in FIG. 5, housing posts 8 and 9 on each end of each upstream and downstream side of the work rolls 4 and 5, support, directly or through Mae West blocks, work roll bending and crossing (or off-setting) rollers 11 and 12.

As also shown in FIG. 5, roll grinders 13 adjacent and movable into and out of contact with each of the work rolls, are installed on the mill housing, outside the rolling mill stand, thus providing appropriate operating conditions for accurate work roll grinding. With use of this invention, theoretically, the work rolls can be kept in the mill until the initial full hardness layer of the rolls is utilized in an extended rolling schedule. However, the system according to this invention further provides equipment, located outside the mill stand, for online rehardening and cooling of the work rolls. Thus, as shown in FIG. 5, heating means comprising housings 14 and 15 enclosing electrical induction elements 16 and 17 are installed outwardly of the grinders 13 at either end and on both sides of the work rolls 4 and 5 to inductively heat and reharden the work rolls after prolonged use, and without removing the work rolls from the rolling stand. Similarly, cooling means such as water sprays 18 are provided outwardly of the induction heaters to cool the heated and hardened work rolls. The roll grinding, rehardening and cooling equipment is located on both sides of the mill, providing a treatment of both halves of the work rolls along their length.

Figure 6:
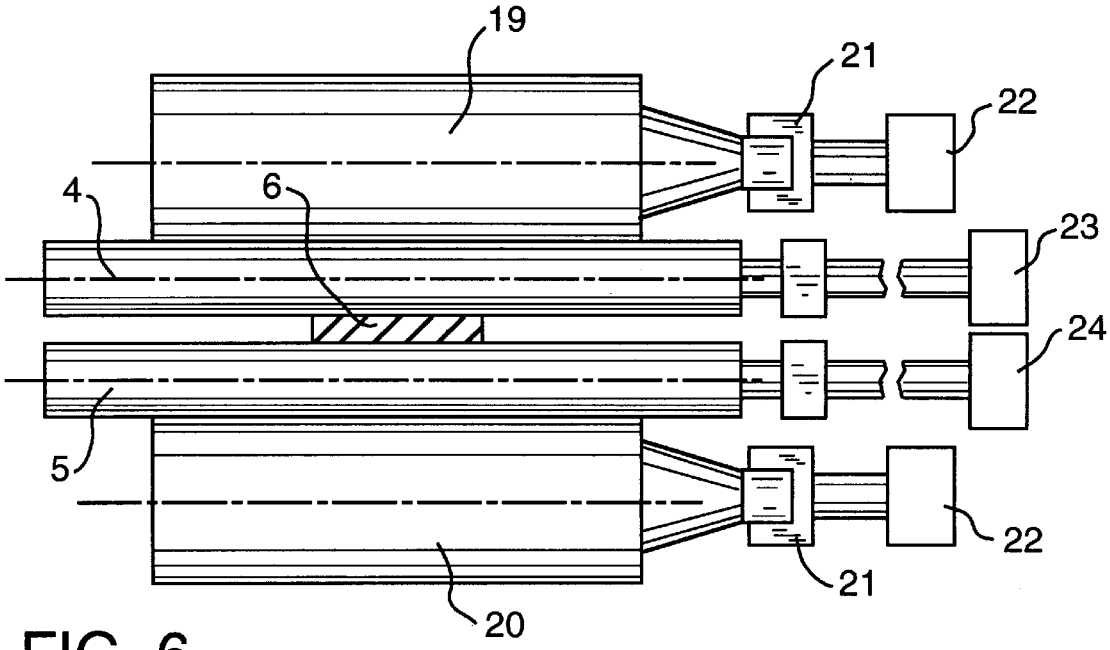
FIG. 6 is an end elevation of a rolling stand according to the invention, showing driven backup rolls and work roll shifting piston/cylinder assemblies.

In the practice of this invention, it is preferred to provide means to drive only backup rolls and not the work rolls themselves. As shown in FIG. 6, a pair of upper and lower backup rolls 19 and 20, each driven through a spindle 21 by a motor 22, are provided for backing up and driving the work rolls 4 and 5. The pistons of axially movable piston/cylinder assemblies 23 and 24 are connected to the ends of the corresponding work rolls and serve, on actuation of the cylinders, to axially shift the corresponding work rolls. It is to be understood that similar backup roll drive means and similar work roll shifting means are provided at either end of each roll. It is because of the presence of the roll grinding, rehardening and cooling means and the shifting piston/cylinder assemblies associated with the work rolls that it is more practical to avoid more complicated accompanying equipment, such as telescopic spindles, and to drive the work rolls only through the driven backup rolls.

Figure 7:
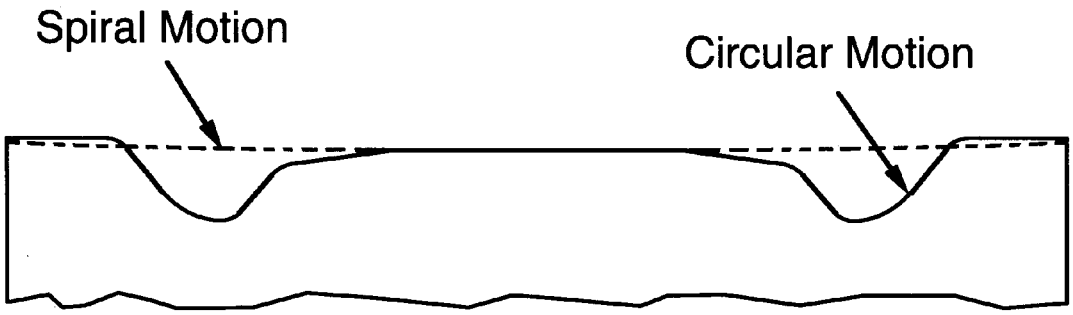
FIG. 7 is a side elevational sketch across the length of a work roll and showing, in exaggerated dimensions, the types of work roll wear produced by the conventional circular work roll motion vs. that produced by the practice of this invention.

FIG. 7 shows the improved (decreased) work roll wear when using the present invention, as compared to conventional rolling, and particularly the substantial elimination of edge wear experienced with conventional rolling. Instead, with the long stroke roll shifting during rolling, as contemplated by this invention, work roll wear is evenly distributed along the full length of the roll face.

Figure 8:
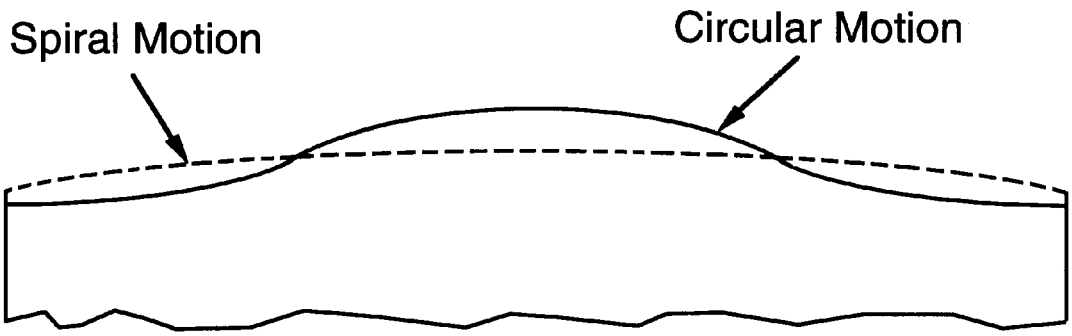
FIG. 8 is a side elevational sketch across the length of a work roll and showing, in exaggerated dimensions, the types of work roll thermal expansions produced by the conventional circular work roll motion vs. that produced by the practice of this invention.

Conventional roll shifting distributes the roll thermal expansion along the roll barrel, but such distribution is limited because the roll shifting stroke is short in respect to the strip width. FIG. 8 shows that the distribution of the work roll thermal expansion is improved due to the continuous axial shifting of the work rolls during the rolling cycle, and also because the roll shifting stroke is greater than the strip width. This improvement is clearly evidenced by this Fig. which shows the substantial elimination of the central thermal crown resulting from conventional rolling.

What is claimed is:

1. A continuous spiral motion system for rolling elongated strip in a rolling mill stand, including mill housing posts, comprising at least one pair of upper and lower work rolls wherein each work roll has a length substantially greater than a width of strip to be rolled, a backup roll corresponding to each work roll, means to continuously axially shift the work rolls during rolling of the strip such that, with a rotating motion of the work rolls, to provide a spiral rolling motion of the work rolls in respect to the rolled strip and, a roll grinder mounted outside at least one such mill housing post online with and movable toward and away from a corresponding work roll to grind the work roll after an initial hardened layer of the work roll has been removed in rolling the strip, without removal of the work roll from the mill stand.

2. A system according to claim 1, wherein the work roll axially shifting means comprises an hydraulic piston/cylinder arrangement disposed in an axial direction of each work roll outwardly of each end of the work roll and having the piston of the assembly connected to a corresponding end of the work roll, and adapted, on actuation of the cylinder, to shift the corresponding work roll in an axial direction.

3. A system according to claim 2, further comprising means to drive each backup roll and thereby to drive a corresponding work roll in a circular rotational movement during work roll shifting and to impart a spiral motion to the work roll during rolling.

4. A system according to claim 3, further comprising work roll bending, crossing and offsetting rollers mounted in the mill housing posts.

5. A system according to claim 4, further comprising means disposed outside the mill housing posts online with each work roll and outwardly of a corresponding roll grinder to heat reharden a work roll surface without removal of the work roll.

6. A system according to claim 5, wherein the work roll rehardening means is an electrical induction heater.

7. A system according to claim 6, further comprising means disposed outside the mill housing post online with each work roll and outwardly of a corresponding work roll heat rehardening means to cool a hot, rehardened work roll.

8. A system according to claim 7, wherein the work roll cooling means is a water spray.

9. A system for improving properties of a metal strip during rolling between rotating upper and lower work rolls in a mill stand, including mill housing posts, for reducing work roll edge wear, for improving distribution of thermal expansion of the work roll during rolling, for reducing required rolling torque for achieving a particular strip thickness reduction, and for increasing the tonnage of rolled strip between roll changes, comprising means to continuously shift the rotating work rolls during rolling to impart a spiral motion to the work rolls, and means to online grind, heat reharden and cool the work rolls with such grinding, rehardening and cooling means being located outside at least one such mill housing post of the mill stand.

10. A system for spiral rolling of an elongated strip in a rolling mill stand, including mill housing posts, comprising at least one pair of upper and lower work rolls, each of which is of a length substantially greater than a width of a strip to be rolled, means to rotate the work rolls in a circular motion during rolling, and means to continuously axially shift the rotating work rolls during a rolling cycle in which, at a beginning of the cycle, the strip is rolled between opposite first end portions of the work rolls and, as the cycle continues, between progressively more centrally located portions of the work rolls and then between less centrally located portions of the work rolls, and, at the end of the cycle, between opposite second end portions of the work rolls, such system further comprising a roll grinder located outside at least one of the mill housing posts, online with and movable toward and away from a corresponding work roll, to grind the work roll after an initial hardened layer of the work roll has been removed in rolling the strip, without removal of the work roll from the mill stand.

11. A method of rolling elongated metal strip between rotating upper and lower work rolls in a rolling mill stand, including mill housing posts, comprising providing work rolls of a length substantially greater than a width of a strip to be rolled, and continuously axially shifting the rotating work rolls to impart thereto a spiral motion with respect to the strip being rolled and a three dimensional deformation of the strip during rolling, thereby reducing the magnitude of applied rolling torque required for a particular strip thickness reduction, improving physical properties of the rolled strip, reducing edge wear of the work rolls, and improving even distribution of work roll thermal expansion during rolling as compared to conventional rolling with rotating work rolls without such continuous work roll shifting, such method further comprising after substantial loss of work roll initial hardened surface, online grinding, heat rehardening and cooling of a work roll performed outside the mill housing posts of the rolling mill stand, whereby tonnage of strip rolled between roll changes is substantially increased as compared to conventional online grinding of a work roll between drive side and operator side mill housing posts of the mill stand.

12. A method according to claim 11, wherein heat rehardening of a work roll is performed with use of an electrical induction heater.

13. A method according to claim 12, wherein cooling of a heat rehardened work roll is performed with a water spray directed against the heated work roll.

14. A method according to claim 11, further comprising rotating the work rolls by means of driven backup rolls.

15. A method according to claim 11, wherein the metal strip is a silicon steel, and the magnetic properties of the steel are improved as compared to such properties of strip deformed two-dimensionally during rolling without continuously work roll shifting.

16. A method for improving properties of a metal strip during rolling between rotating upper and lower work rolls in a mill stand, including mill housing posts, for reducing work roll edge wear, for improving distribution of thermal expansion of the work roll during rolling, for reducing required rolling torque for achieving a particular strip thickness reduction, and for increasing the tonnage of rolled strip between roll changes, comprising continuously shifting the rotating work rolls during rolling to impart a spiral motion to the work rolls, and online grinding, heat rehardening and cooling of the work rolls, with such operations being performed outside mill housing posts of the mill stand.

17. A method for spiral rolling of an elongated strip in a rolling mill stand, including mill housing posts, having at least one pair of upper and lower work rolls, comprising providing work rolls each of which is of a length substantially greater than a width of a strip to be rolled, rotating the work rolls in a circular motion during rolling, and continuously axially shifting the rotating work rolls during a rolling cycle in which, at a beginning of the cycle, the strip is rolled between opposite first end portions of the work rolls and, as the cycle continues, between progressively more centrally located portions of the work rolls and then between less centrally located portions of the work rolls, and, at the end of the cycle, between opposite second end portions of the work rolls, such method further comprising online grinding, heat rehardening and cooling of the work rolls outside said mill housing posts of the mill stand.

* * * * *

UNITED STATES PATENT OFFICE
CERTIFICATE OF CORRECTION

PATENT NO.: 5,970,771
DATED : October 26, 1999
INVENTOR(S): Vladimir B. Ginzburg It is certified that error appears in the above-identified patent and that said Letters Patent is hereby corrected as shown below:

On the title page: Item [73] Assignee:

Danieli United; International Rolling Mill Consultants, Inc., Both of Pittsburgh, PA Signed and Sealed this Twenty-eighth Day of March, 2000

*Attest:*

Q. TODD DICKINSON

*Attesting Officer*

*Commissioner of Patents and Trademarks*